US006517393B1

(12) United States Patent
Blanche et al.

(10) Patent No.: US 6,517,393 B1
(45) **Date of Patent: *Feb. 11, 2003**

(54) RANGE PLUG

(75) Inventors: Stephen A. Blanche, Warwick, RI (US); Thomas R. Varatta, Johnston, RI (US)

(73) Assignee: ETCO Incorporated, Warwick, RI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/982,921

(22) Filed: Dec. 2, 1997

(51) Int. Cl.[7] ..... H01R 13/02
(52) U.S. Cl. ..... 439/884; 439/881

(58) Field of Search ..... 439/694, 881, 439/884

(56) References Cited

U.S. PATENT DOCUMENTS

| | | | | | |
|---|---|---|---|---|---|
| 2,923,912 | A | * | 2/1960 | Benander | 439/694 |
| 3,609,630 | A | * | 9/1971 | Francis | 439/694 |
| 4,927,376 | A | * | 5/1990 | Dickie | 439/484 |
| 5,662,484 | A | | 9/1997 | Blanche | |
| 5,681,192 | A | * | 10/1997 | Kobayashi et al. | 439/884 |

* cited by examiner

*Primary Examiner*—Khiem Nguyen

(57) ABSTRACT

Range plug blades with integral conductor-accepting cups bisected by planes parallel with the blades are inserted into plug die slots, following which conductors are crimped into the cups, after which plastic is introduced into the die and hardened into a range plug holding the blades, cups, and conductors in predetermined positions.

24 Claims, 4 Drawing Sheets

RANGE PLUG

FIELD

This invention relates to high amperage plugs for use for example in connection with electric ranges, and more particularly with the manufacture into such plugs of its blades.

BACKGROUND

It is known in the prior art to manufacture range plugs by crimping into blade cups, bisected by planes perpendicular to planes of the blades, bundles of small-diameter conductors, and thereafter by hand twisting the crimped bundles into blade parallelism and inserting thereupon the blades into an injection die.

The prior art would also optionally incorporate into the plug a round ground pin, in which case cups, integral with the pins with bisectors in planes perpendicular to the pin axes, would have crimped thereinto groups of conductor wires, and each pin would be wiggled into a die hole in the same general overall intensively repetitive motions in which the blades were brought into alignment and fitted in their die holes.

Range blade thicknesses in the prior art were 0.095–0.105 inches in overall thickness, while ordinary household plug blades had thicknesses, overall, of 0.055 to 0.065 inches.

Blanche U.S. Pat. No. 5,662,484, "Bridged Electrical Plug", discloses a plug for smaller voltages in which are provided for crimping thereinto conductors three cups opening in parallel directions perpendicular to the longitudinal direction of the folded blades with which the cups are integral.

Bases with preformed halves, thermoplastically welded together, are known in the prior art.

SUMMARY

We have discovered that such plugs may be better manufactured by reorienting the blade conductor contact surfaces so that in the novel blades each of the surfaces' line generators is parallel with the bisector plane of its respective blade; by positioning the blades before securing thereinto the conductors; and by then securing the contact surfaces to their conductors.

In preferred embodiments, the cup bisectors are parallel with blade and pin bisectors, and blade thickness is achieved by centrally outwardly opposingly embossing integral pairs of blade portions.

PREFERRED EMBODIMENT

Now disclosed are preferred embodiments, in structure and operation, and in the light of the drawings.

Drawings

Structure

Figure 1:
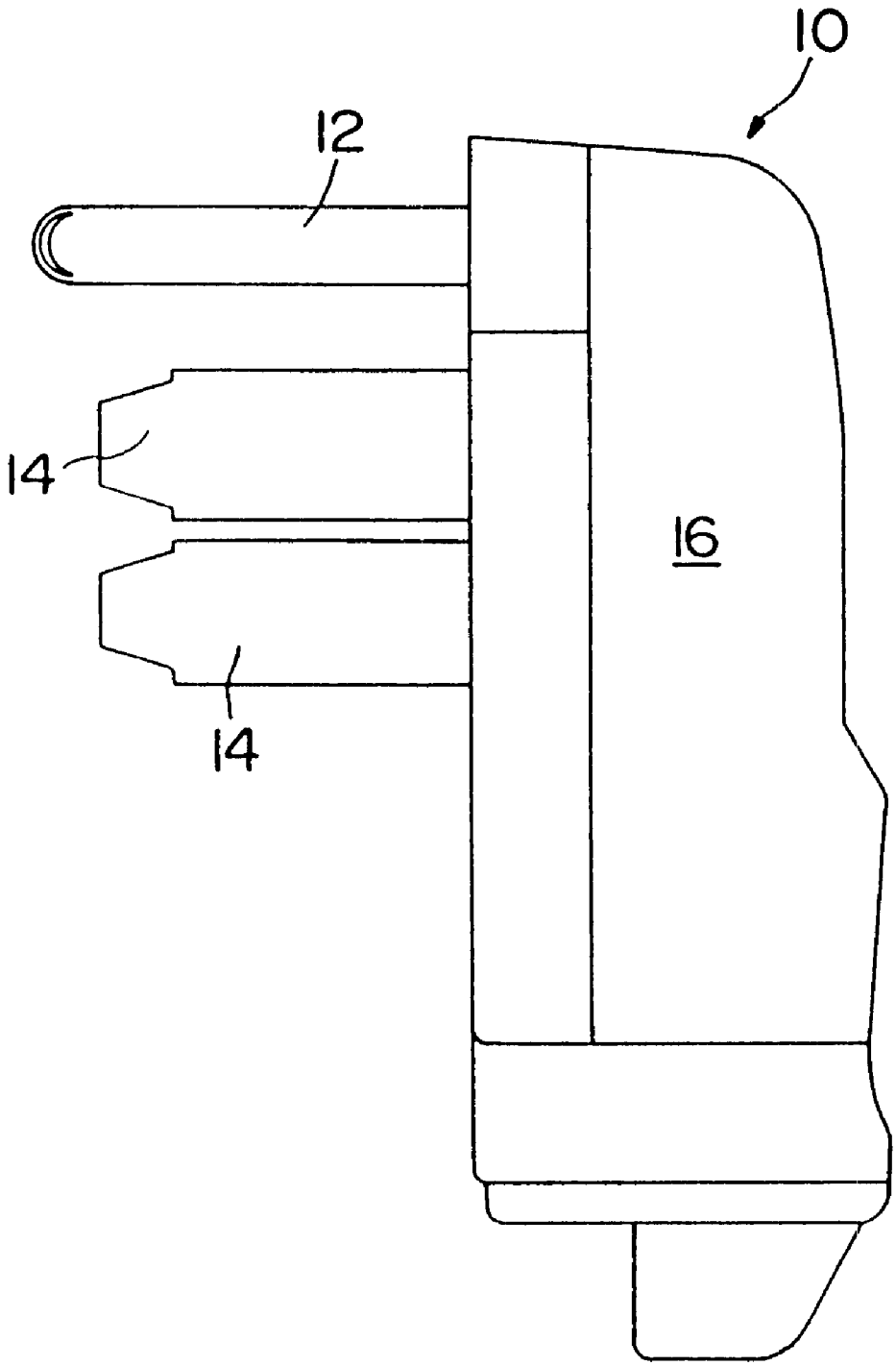
FIG. 1 is a side view of a range plug according to the invention.
Figure 4:
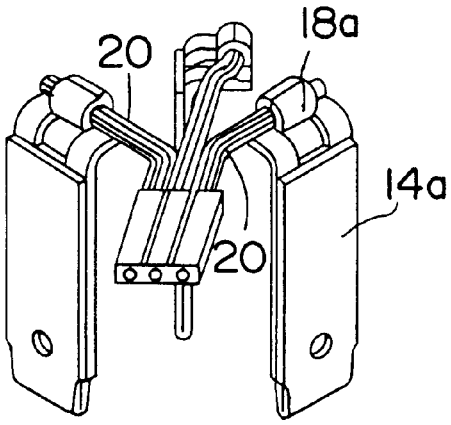
FIG. 4 Prior Art
FIG. 4 is an isometric view of the grouping of FIG. 2 after reorientation, in the prior art mode, by hand.

Shown in FIG. 1 is a range plug indicated generally at 10 which has a hollow ground pin 12, of outwardly generally circular cylindrical surface with a semispherical end, as well known in the art, and three blades 14 (one of them directly behind the upper blade 14 shown in FIG. 1), all anchored in a polyvinyl chloride base 16 injection molded insulatively around them. (A conventional cable with four twisted-wire connectors, each insulated generally, and from one another, by integral plastic—as shown in FIG. 4 but not shown in FIG. 1—emerges from base 16, within which the connectors are respectively crimped into cups of pin 12 and blades 14.)

Figure 2:
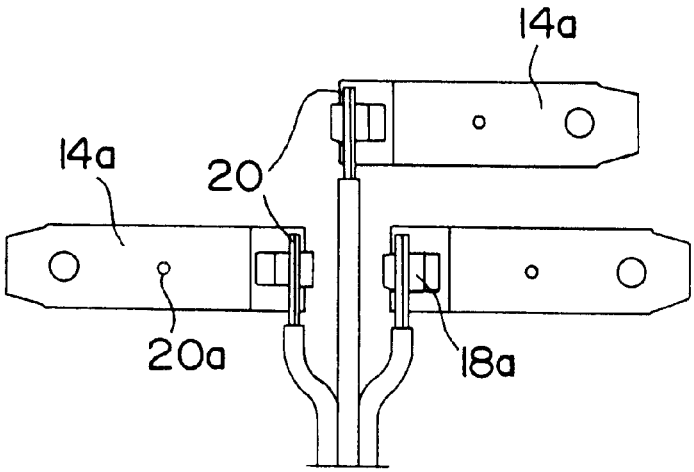
FIG. 2 Prior Art
FIG. 2 is a plan view, arranged as though of a prior art assembly, prior to the twisting by hand of the three blades shown into parallel and insertion into die slots.
Figure 3:
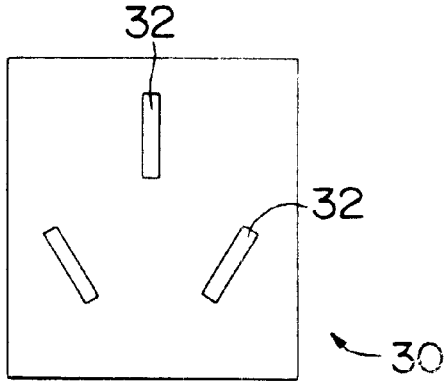
FIG. 3 Prior Art
FIG. 3 is a plan view of a die portion showing such die slots.

Shown in FIG. 2 are three range blades 14*a* of the invention with wire bundles 20 crimped into cups 18*a* having bisector planes parallel to the center planes of the folded blades 14*a*, but in a prior art grouping. It was the prior art approach to then bend the assembly by hand to reorient the blades as shown in FIG. 4, to fit into a die portion as shown in FIG. 3, a repetitive task neither pleasant nor good for the hands and wrists.

Figure 5:
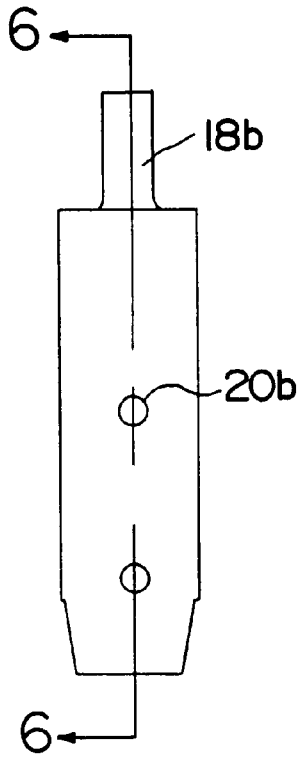
FIG. 5 is a side view of a preferred blade according to the invention.
Figure 6:
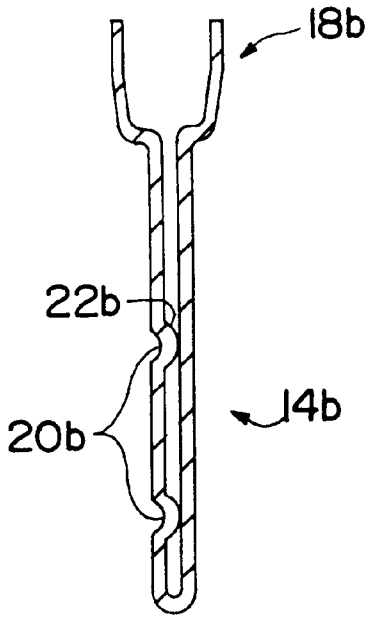
FIG. 6 is a sectional view of the blade of FIG. 5 at 6—6 of FIG. 5.

A preferred blade embodiment of my invention is shown in FIGS. 5 and 6, and includes a semi- (non-circular) cylindrical cup portion 18*b* coincident in its bisector with that of the integrally attached blade 14*b*. Included in one of the folded portions of blade 14*b* are two indentations or dimples 20*b* which produce corresponding parallel inner bumps 22*b* selected in respective depth and protrusion (the preferred embodiment being exaggerated diagrammatically in FIG. 6) to fine tune as desired the overall thickness therethrough of folded blades 14*b*.

Figure 7:
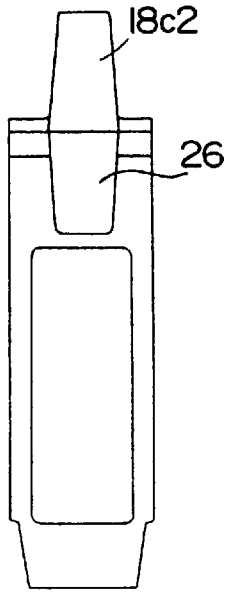
FIG. 7 is a side view of the presently most preferred embodiment of a blade of the invention.
Figure 8:
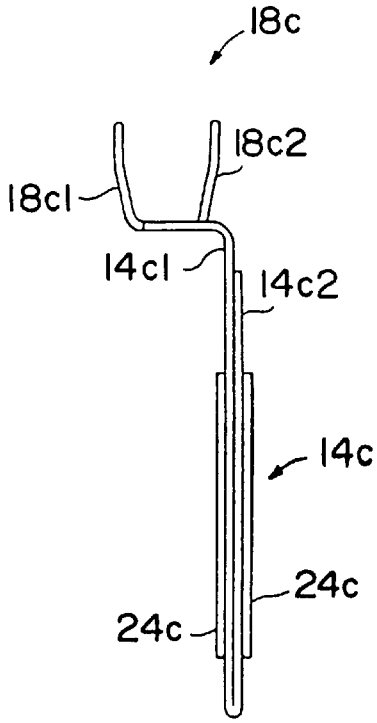
FIG. 8 is an end view of the blade of FIG. 7.

The presently most preferred embodiment of the blades of the invention is shown in FIGS. 7 and 8. In this embodiment the bisector of cup 18*c* is parallel with and offset from the bisector of blade 14*c*, and blade 14*c* is made of 0.030 inch thick brass stock (only two-thirds of the thickness of the 0.045 inch thick stock of FIGS. 5 and 6 and typical prior art), and overall effective thickness of twice that is achieved on doubling and matingly outwardly embossing in transverse and longitudinal alignment into the inner surfaces of the blade portions of blades 14*c* to produce the cooperating outwardly extending protrusions 24*c*. Cup portion 18*c*1 is an integral central extension of blade portion 14*c*1. Cup portion 18*c*2 is a struck-out portion of blade portion 14*c*2 (leaving therethrough opening 26).

In both embodiments, the conductor engaging surface of the cup opening from the end of the blade away from its plug extremity and integral with that end away from the plug extremity is generated by a line moving parallel to the blade bisector and the lines referred to are parallel for at least two conductor engaging surfaces, which may be, e.g., planar if welding is to be the mode of securing. (The word "parallel" as used here is applicable also to the device of FIGS. 5 and 6, which should be treated as in the real world and not, like "planar" in Euclidean theory.)

Operation

Pursuant to the invention, three blades 14*c* are inserted in die portion 30 slots 32. Tooling then crimps wire bundles (as 20 in FIGS. 2 and 4) into cups.

The opening of the cups all in the same direction permits simultaneous same direction movement of conductor loading and cup crimping tooling. Prior art worker repetitive motion is here eliminated.

Injection molding into the die portion 30 to fix in predetermined position the blades 14*c*, crimped cups 18*c*, and wire bundles 20 may then be completed.

OTHER EMBODIMENTS

Other embodiments within the invention will occur to those skilled in the art. For example, connectors may be solid rather than bundles of smaller wire. The lines used to generate contact surfaces may move in a plane parallel to the blade bisector plane, and generate thus a plane contact surface to which a connector may be welded, rather than a semicylindrical surface as in the preferred embodiments, into which the connector is crimped. The base may be preformed in upper and lower halves, one half of which includes slots formed into it, following which blades may be slipped into the slots as they were slots in the die portion above described, the connector members be crimped or welded to the blades, and the halves then secured together. In any case the contact surface is defined by movement of a line parallel with a line in the blade's bisector plane and perpendicular to the blade's longitudinal axis); and the other half of the base snapped in.

What is claimed is:

1. A high amperage plug comprising a base and a plurality of range blades, said range blades having each a longitudinally extending blade portion and a cup portion integral with each said blade portion at an end of said longitudinally extending blade portion, said cup portion being arranged to accept therein and be crimped over to secure therein an elongated electrical current carrier, said cup portion opening in a longitudinal direction generally corresponding with that of said longitudinally extending blade portion, and away therefrom, and opening also at each transverse end of said cup portion in a transverse direction, said transverse direction being perpendicular to said longitudinal direction, said base comprising a molded material holding said blades in a predetermined position and providing insulation therebetween.

2. The plug of claim 1 which is a range plug and in which said blade portion is folded on itself at its end away from said cup portion.

3. The range plug of claim 2 in which said blade portion includes an offset depression in one face to produce a corresponding protrusion in the other face, with an overall increase in the thickness of said blade portion.

4. The range plug of claim 3 in which said blade portion is folded on itself at its end away from said cup portion to provide first and second layers, each of said layers being provided with an offset depression in its inner face and a corresponding protuberance on its outer face, the depressions being aligned.

5. The range plug of claim 3 in which at least one said blade portion has a cup portion with a generally half cylindrical inner surface symmetrical about a bisector plane parallel to but transversely offset from the bisector plane of said integral blade portion.

6. The range plug of claim 3 in which at least one said blade portion has integral therewith a cup portion open away from said blade portion and with a bisector coplanar with the bisector of said blade portion.

7. A range blade comprising a longitudinally extending blade portion and a cup portion integral with said blade portion at an end of said longitudinally extending blade portion, said cup portion being arranged to accept therein and be crimped thereover to secure therein an elongated electrical current carrier, and said cup portion opening in a direction generally corresponding with that of said longitudinally extending portion, and away therefrom.

8. The range blade of claim 7 in which said blade portion is folded on itself at its end away from said cup portion.

9. The range blade of claim 7 in which said blade portion includes an offset depression in one face to produce a corresponding protrusion in the other face, with an overall increase in the thickness of said blade portion.

10. The range blade of claim 9 in which said blade portion is folded on itself at its end away from said cup portion to provide first and second layers, each of said layers being provided with an offset depression in its inner face and a corresponding protuberance on its outer face, the depressions being aligned.

11. The range blade of claim 7 in which at least one said blade portion has a cup portion with a generally half cylindrical inner surface symmetrical about a bisector plane parallel to but transversely offset from the bisector plane of said integral blade portion.

12. The range blade of claim 7 in which at least one said blade portion has integral therewith a cup portion open away from said blade portion and with a bisector coplanar with the bisector of said blade portion.

13. The method of making a range plug which comprises:

positioning a die containing longitudinally extending slots, placing in said slots range blades, said blades including cup portions opening in a corresponding but opposite longitudinal direction, placing in said portions elongated electrical conductors, crimping said portions therearound, and fixing said blades and conductors into predetermined relative positions by applying thereto an insulative base.

14. The method of claim 13 in which said applying is by injection molding.

15. A high amperage plug comprising a base and a plurality of range blades, said range blades having each a longitudinally extending blade portion and a transverse cup portion integral with said blade portion at an end of said longitudinally extending blade portion, said cup portion being arranged to accept therein and be crimped thereover to secure therein an elongated electrical current carrier, said cup portion opening in a longitudinal direction generally corresponding with that of said longitudinally extending portion, and away therefrom, and at opposite transverse ends of said cup portion opening in opposed transverse directions, said base comprising a molded material holding said blades in a predetermined position providing insulation therebetween, and comprising also a longitudinally extending contact portion and integral therewith at an end thereof a cylindrical cup facing away from said contact portion with a bisector extending outwardly in a direction 180 degrees from the direction of said contact portion from said cup.

16. The range plug of claim 3 in which the overall thickness of said range blade is in the range of 0.095 to 0.105 inches.

17. A high amperage plug comprising a base and a plurality of range blades, said blades having each a longitudinally extending blade portion and a contact portion integral with said blade portion at an end of said blade portion, said contact portion having a contact surface defined by moving a line parallel to said blades, and said contact surface facing away from said blade portion.

18. The method of claim 13 in which said cup portions are provided with contact surfaces defined by moving lines perpendicular to integral said blades along paths defined by lines parallel to the surfaces of said blades.

19. The range blade of claim 1 in which each said cup portion is bisected by a plane extending in a transverse direction and one of parallel to or coincident with larger areas of said blade surfaces.

20. The range blade of claim 7 in which said cup portion extends transversely of said range and in directional parallelism with larger areas of the surfaces of said range blade.

21. The range blade of claim 20 in which the center plane of said cup portion is offset from said blade.

22. The range blade of claim 20 in which the center plane of said cup portion and said blade portion are coincident.

23. The range blade of claim 21 in which said range blade has a folded integral pair of half blades, and said cup portion constitutes a formed free end of one of said half blades and a stamped out and formed portion of the other one of said half blades.

24. The range blade of claim 22 in which said range blade has a folded integral pair of half blades, and said cup portion constitutes cooperating formed free ends of said pair.

* * * * *